US008769854B1

(12) United States Patent
Battaglia

(10) Patent No.: US 8,769,854 B1
(45) Date of Patent: Jul. 8, 2014

(54) SOLID CHASSIS RIFLE

(76) Inventor: Vincent P. Battaglia, Easton, CT (US)

( * ) Notice: Subject to any disclaimer, the term of this patent is extended or adjusted under 35 U.S.C. 154(b) by 0 days.

(21) Appl. No.: 13/443,346

(22) Filed: Apr. 10, 2012

(51) Int. Cl.
*F41A 11/02* (2006.01)

(52) U.S. Cl.
CPC ..... *F41A 11/02* (2013.01)
USPC ..... 42/75.03; 42/71.01; 42/75.01

(58) Field of Classification Search
CPC ..... F41C 23/16; F41C 23/04; F41C 23/20; F41C 23/12; F41C 27/00; F41A 3/66; F41A 11/02
USPC ..... 42/75.01–75.04, 71.01
See application file for complete search history.

(56) References Cited

U.S. PATENT DOCUMENTS

| | | | | |
|---|---|---|---|---|
| 2,387,691 | A * | 10/1945 | Sunderland | 89/149 |
| 3,348,328 | A | 10/1967 | Roy | |
| 3,739,515 | A * | 6/1973 | Koon, Jr. | 42/75.03 |
| D598,971 | S | 8/2009 | Peterson et al. | |
| 7,647,719 | B2 | 1/2010 | Fitzpatrick et al. | |
| 7,685,757 | B2 * | 3/2010 | Rohrauer | 42/75.01 |
| D613,361 | S | 4/2010 | Peterson et al. | |
| D613,812 | S | 4/2010 | Peterson et al. | |
| D623,718 | S | 9/2010 | Peterson et al. | |
| 7,802,392 | B2 | 9/2010 | Peterson et al. | |
| D626,618 | S | 11/2010 | Peterson et al. | |
| D629,062 | S | 12/2010 | Peterson et al. | |
| D630,698 | S | 1/2011 | Peterson et al. | |
| D634,388 | S | 3/2011 | Peterson et al. | |
| D637,680 | S | 5/2011 | Peterson et al. | |
| D643,085 | S | 8/2011 | Peterson et al. | |
| D643,086 | S | 8/2011 | Peterson et al. | |
| D645,532 | S | 9/2011 | Peterson et al. | |
| D645,533 | S | 9/2011 | Peterson et al. | |
| D646,745 | S | 10/2011 | Peterson et al. | |
| 8,028,456 | B2 | 10/2011 | Peterson | |
| 8,066,236 | B2 | 11/2011 | Peterson et al. | |
| 2004/0211104 | A1 | 10/2004 | Eberle | |
| 2005/0115135 | A1 | 6/2005 | Thompson | |
| 2005/0215092 | A1 | 9/2005 | Schoppman et al. | |
| 2008/0236016 | A1 | 10/2008 | Fitzpatrick et al. | |
| 2008/0236017 | A1 | 10/2008 | Fitzpatrick et al. | |
| 2010/0205846 | A1 | 8/2010 | Fitzpatrick et al. | |
| 2010/0307042 | A1 | 12/2010 | Jarboe et al. | |
| 2012/0079752 | A1 * | 4/2012 | Peterson et al. | 42/75.02 |

* cited by examiner

*Primary Examiner* — Bret Hayes
*Assistant Examiner* — Joshua Freeman
(74) *Attorney, Agent, or Firm* — DeLio, Peterson & Curcio, LLC; Peter W. Peterson

(57) ABSTRACT

A rifle assembly includes a central chassis for carrying an action including a trigger and a trigger guard, the central chassis having a front portion and a rear portion, a rifle fore-end for carrying a barrel, the fore-end having a rear portion, and a fore-end adapter having a rear portion removably secured to the central chassis front portion and a front portion removably secured to the fore-end rear portion. The rifle assembly further includes a rifle butt stock having a front portion and a butt stock adapter having a rear portion removably secured to the butt stock front portion and a front portion removably secured to the central chassis front portion.

18 Claims, 6 Drawing Sheets

SOLID CHASSIS RIFLE

BACKGROUND OF THE INVENTION

1. Field of the Invention

This invention relates to a rifle chassis and, in particular, to a rifle chassis that employs adapters to removably secure different butt stocks and forestocks to a central chassis.

2. Description of Related Art

The rifle is comprised of three basic sections so that it is capable of being fired from a shoulder mounted position in standing, sitting or prone. These sections comprise the butt stock, action-trigger area and the fore end. The feature level and configuration of these sections determine the class of rifle, for example, sporting, tactical or a hybrid sporting-tactical dual use weapon. International Traffic in Arms Regulations (ITAR) and other state and federal regulations also define rifle configurations and classifications. Further, there are myriad possible caliber and barrel length configurations for rifles. It would be advantageous to have a rifle assembly that can adapt different butt stocks and forestocks to a central chassis carrying the rifle action and trigger, while ensuring high strength to the conenctions.

SUMMARY OF THE INVENTION

Bearing in mind the problems and deficiencies of the prior art, it is therefore an object of the present invention to provide easy interchangeability of rifle forestocks and butt stocks.

Another object of the present invention is to provide means for removably securing forestocks and butt stocks in a rifle assembly.

A further object of the present invention is to provide high strength connections that removably secure forestocks and butt stocks to a central chassis in a rifle assembly.

Still other objects and advantages of the invention will in part be obvious and will in part be apparent from the specification.

The above and other objects, which will be apparent to those skilled in the art, are achieved in the present invention which is directed to a rifle assembly comprising a central chassis for carrying an action including a trigger and a trigger guard, the central chassis having a front portion and a rear portion, a rifle fore-end for carrying a barrel, the fore-end having a rear portion, and a fore-end adapter having a rear portion removably secured to the central chassis front portion and a front portion removably secured to the fore-end rear portion. The rifle assembly further includes a rifle butt stock having a front portion and a butt stock adapter having a rear portion removably secured to the butt stock front portion and a front portion removably secured to the central chassis front portion.

In another aspect, the present invention is directed to a method of assembling a rifle comprising providing a central chassis for carrying an action including a trigger and a trigger guard, the central chassis having a front portion and a rear portion, providing a rifle fore-end for carrying a barrel, the fore-end having a rear portion, providing a fore-end adapter having a front portion and a rear portion, providing a rifle butt stock having a front portion; and providing a butt stock adapter having a front portion and a rear portion. The method then includes removably securing the fore-end adapter rear portion to the central chassis front portion, removably securing the fore-end adapter front portion to the fore-end rear portion, removably securing the butt stock adapter front portion to the central chassis rear portion, and removably securing the butt stock adapter rear portion to the butt stock front portion.

In one embodiment, the rifle assembly comprises a central chassis for carrying an action including a trigger and a trigger guard, the central chassis having a rearward-facing projection, a butt stock having a front portion with a forward-facing projection, and an adapter having a forward-facing projection abutting the central chassis rearward-facing projection and removably secured thereto, and a rearward-facing projection. One of the adapter rearward-facing projection and the butt stock projection has a fork with vertically spaced brackets above and below the other of the butt stock and adapter rearward-facing projection and is removably secured thereto. The adapter may have a rearward-facing fork with vertically spaced brackets above and below the butt stock projection. One of the adapter forward-facing projection and the central chassis rearward-facing projection may have a slot and the other of the central chassis rearward-facing projection and the adapter forward-facing projection may have a flange slideable within the slot. The adapter forward-facing projection may have a slot and the central chassis rearward-facing projection may have a flange slideable within the slot. The rifle assembly may further include at least one removable fastener disposed between the central chassis rearward-facing projection slot and the adapter forward-facing projection flange. The forward-facing projection of the butt stock may have flanges on at least one side of the brackets of the rearward-facing fork of the adapter. The forward-facing projection of the butt stock may have upwardly- and downwardly-projecting flanges on opposite sides of the brackets of the rearward-facing fork of the adapter. The butt stock forward-facing projection flanges may form slots into which are slideable the brackets of the adapter rearward-facing fork. The rifle assembly may further include at least one removable fastener disposed between the butt stock forward-facing projection flanges and the brackets of the adapter rearward-facing fork. The butt stock forward-facing projection, the adapter rearward-facing fork brackets, the adapter forward-facing projection and central chassis rearward-facing projection may extend in a longitudinal direction of the rifle assembly.

In another embodiment the rifle assembly comprises a central chassis for carrying an action including a trigger and a trigger guard, the central chassis having a rearward-facing portion at an angle to a longitudinal direction of the rifle assembly, a butt stock having a front portion, and an adapter having a forward-facing portion at an angle to the longitudinal direction of the rifle assembly removably secured to the central chassis rearward-facing portion. One of the adapter forward-facing portion and the chassis rearward-facing portion may have a projection and the other of the chassis rearward-facing portion and the adapter forward-facing portion may have a slot, and a rearward-facing portion removably secured to the front portion of the butt stock. The adapter may have a forward-facing slot at an angle to the longitudinal direction of the rifle assembly and the central chassis may have a rearward-facing projection disposed and removably secured in the adapter slot. One of the butt stock front portion and the adapter rearward-facing portion may have an opening at an angle to the longitudinal direction of the rifle assembly and the other of the adapter rearward-facing portion and the butt stock front portion may have a projection at an angle to the longitudinal direction of the rifle assembly slideable within the opening. The butt stock front portion may have a forward-facing opening at an angle to the longitudinal direction of the rifle assembly and the adapter may have a rearward-facing projection at an angle to the longitudinal direction of the rifle assembly slideable within the butt stock front portion opening. The central chassis rearward-facing projection may be a flange slideable within the adapter forward-facing slot. The rifle assembly may further include at least one removable fastener disposed between the central chassis rearward-facing flange and the adapter forward-facing slot.

In a further embodiment the rifle assembly comprises a central chassis for carrying an action including a trigger and a trigger guard, the central chassis having a front portion, a rifle fore-end for carrying a barrel, the fore-end having a rear portion, and an adapter having a rear portion removably secured to the central chassis front portion and a forward-facing fork with spaced brackets adjacent the fore-end rear portion and removably secured thereto. The forward-facing brackets of the adapter may be horizontally spaced and disposed on either side of the fore-end rear portion. The forward-facing brackets of the adapter may be vertically spaced and disposed above and below the fore-end rear portion. The rifle assembly may further include at least one removable fastener disposed between the brackets of the adapter rear portion and the fore-end rear portion. One of the adapter rear portion and the central chassis front portion may have a slot and the other of the central chassis front portion and the adapter rear portion may have a projection slideable within the slot. The adapter rear portion may have a rearward-facing slot and the central chassis front portion may have a forward-facing projection slideable within the slot. The central chassis forward-facing projection may be a flange slideable within the adapter rearward-facing slot. The adapter forward-facing fork brackets may extend in a longitudinal direction of the rifle assembly.

The rifle assembly may further include a leg movably secured by a pivot at a rear portion of the butt stock. The leg extends forward toward the fore end, and is securable at a desired position to position the butt stock at a desired elevation above a surface.

BRIEF DESCRIPTION OF THE DRAWINGS

The features of the invention believed to be novel and the elements characteristic of the invention are set forth with particularity in the appended claims. The figures are for illustration purposes only and are not drawn to scale. The invention itself, however, both as to organization and method of operation, may best be understood by reference to the detailed description which follows taken in conjunction with the accompanying drawings in which:

DESCRIPTION OF THE PREFERRED EMBODIMENT(S)

In describing the preferred embodiment of the present invention, reference will be made herein to FIGS. 1-13 of the drawings in which like numerals refer to like features of the invention.

The present invention employs a center chassis rifle core assembly with adapters for removably securing the fore-end and butt stock in multiple configurations. The butt stock, center chassis core and fore-end are operatively connected in a desired configuration to provide the desired ergonomic configuration of the weapon. The present invention provides a means to adaptively change the butt stock as well as the forestock and entire barreled action and quickly replace it with another assembly.

Figure 1:
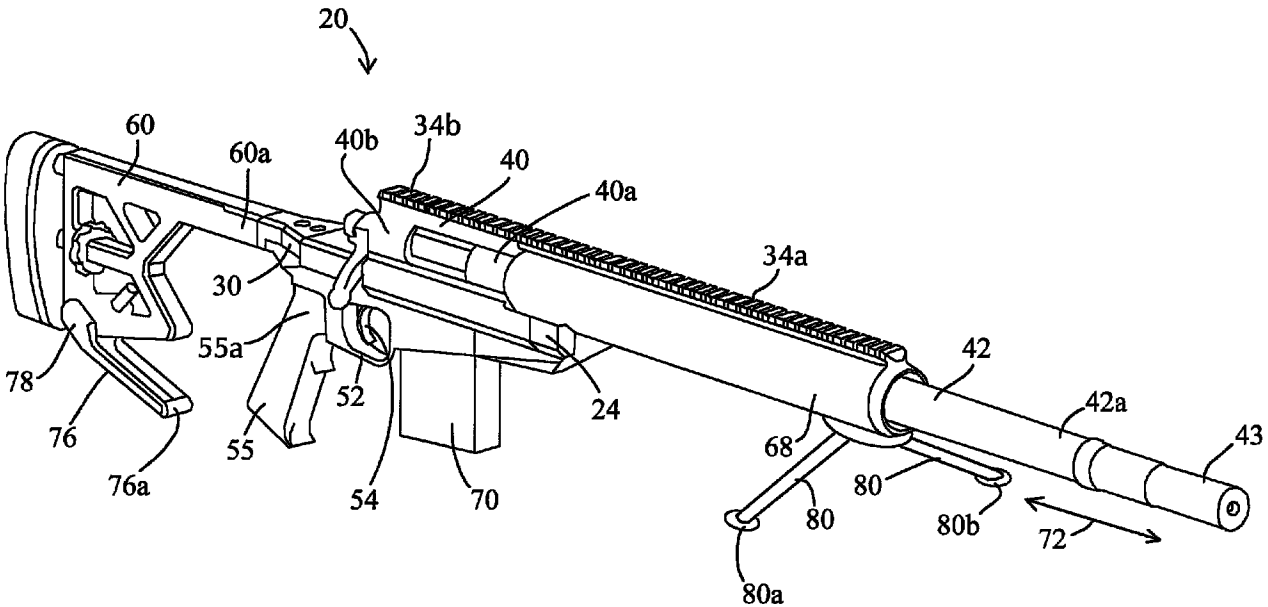
FIG. 1 is a perspective view of the assembled rifle made from an embodiment of the present invention.
Figure 2:
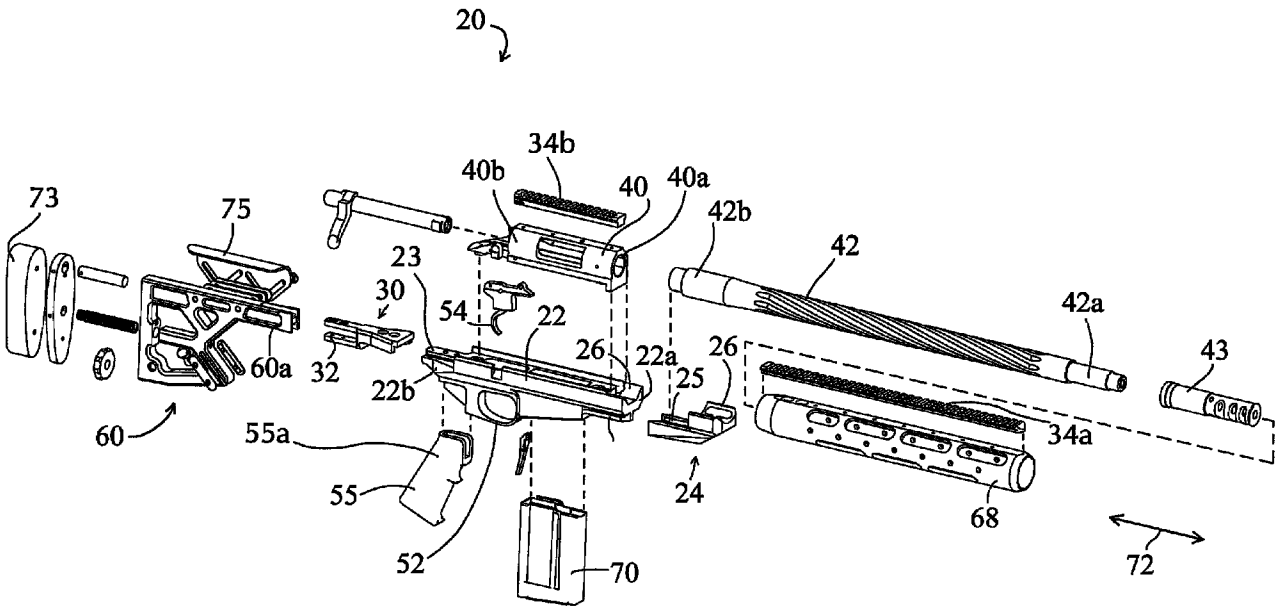
FIG. 2 is an exploded perspective view of the rifle of FIG. 1 showing some of the components of the rifle assembly of the present invention.
Figure 3:
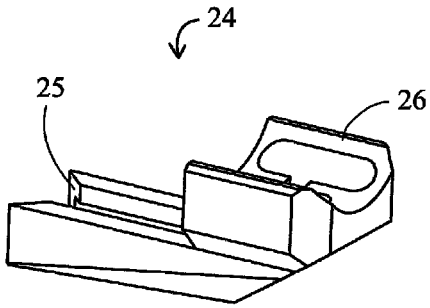
FIG. 3 is a perspective view of the forestock adapter shown in FIG. 2.
Figure 4:
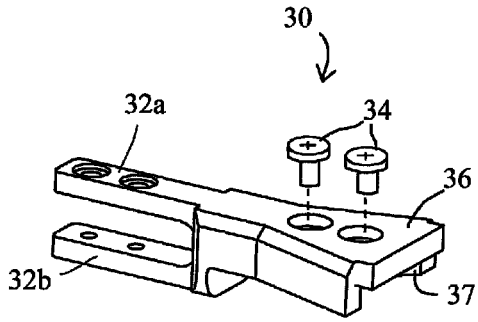
FIG. 4 is a perspective view of the butt stock adapter shown in FIG. 2.
Figure 5:
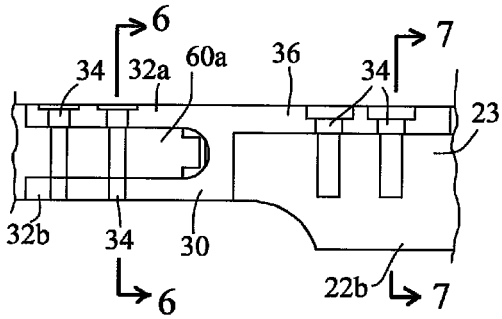
FIG. 5 is a longitudinal cross-sectional view of the butt stock adapter connecting the butt stock and chassis of the rifle assembly of FIGS. 1 and 2.
Figure 6:
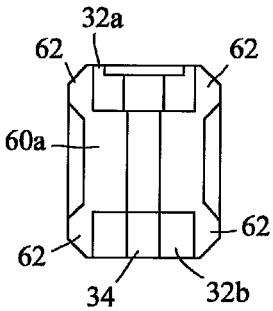
FIG. 6 is a transverse cross-sectional view of the butt stock adapter connection to the butt stock of the rifle assembly of FIGS. 1 and 2 along line 6-6 in FIG. 5.
Figure 7:
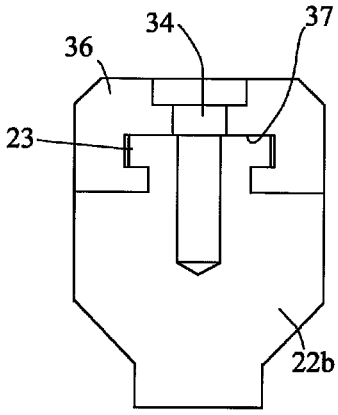
FIG. 7 is a transverse cross-sectional view of the butt stock adapter connection to the central chassis of the rifle assembly of FIGS. 1 and 2 along line 7-7 in FIG. 5.

A first embodiment of a modular rifle assembly 20 is shown in FIGS. 1 and 2 and includes a central chassis 22 having front 22*a* and rear 22*b* portions aligned along longitudinal axis 72*b*, which is parallel to the longitudinal axis 72 of the assembled rifle. The central chassis may be made of a metal or alloy such as forged aluminum, a composite material, or a combination such as a sheet steel stamping molded into a polymer. Central chassis 22 may include a trigger guard 52 that receives trigger 54 extending downward from action 40, which may be selected to permit the rifle system to fire any desired different calibers, sizes and types of ammunition cartridges. The rifle action 40 may be a bolt-type or other working mechanism to mechanically load a cartridge from a magazine 70 and fire it through barrel 42, including automatic, semi-automatic, lever or side lock actions. A barrel 42 may include a replaceable muzzle end 43 at its front end 42*a*, and is secured at its rear end 42*b* to the front end 40*a* of action 40. A pistol grip 55 may be attached below the trigger guard 52. Unless otherwise noted, all directions are with respect to the completed rifle assembly as normally fired with axis 72 in the horizontal position.

The modular rifle assembly includes at the fore-end a removably secured forestock 68 extending forward of the central chassis front portion 22*a* that receives the rifle barrel 42, and at the rear end a removably secured butt stock 60 that contacts the user's shoulder during firing. As used herein, the terms "removably secure," "removably securable" and "removably connected" means that the component or part may be connected, locked or otherwise secured into position for use in firing the gun, and may be repeatedly removed or disassembled as desired by the user, without impairing the usefulness of the gun. Mechanical or other reusable means may be employed to removably secure the parts or components in the gun for firing, such as screws, bolts, pins and other fasteners. These terms exclude the use of permanent or semi-permanent securing means such as adhesives or rivets. Adapters are described herein to removably secure the rifle components, and such adapters may be made of a metal or alloy such as steel or aluminum, a polymer or a composite of the aforestated materials.

Fore-end or forestock 68 may be removably secured to the central chassis by a forestock adapter 24 (FIG. 3) having a cradle portion 26 on the upper side that connects to the rear underside portion of the forestock. Forestock adapter 24 has a rearward facing slot 25 that slides longitudinally into a corresponding flange 21 on the underside of chassis front portion 22*a*, which also permits the rear underside portion of the forestock to connect to cradle portion 26 on the upper side of chassis front portion 22*a*. Picatinny-type rails 34*a*, 34 *b* may be secured to the top of the forestock 68 and chassis 40, respectively.

A butt stock adapter 30 (FIG. 4) removably secures the butt stock 60 to the rear end 22*b* of central chassis member 22. As shown in FIGS. 1 and 2, butt stock 60 is made of metal or composite construction, e.g., aluminum or steel, but any other material may be used. Otherwise conventional adjustable shoulder 73 and cheek 75 pieces permit fitting of the butt stock to the shooter operating the rifle. Butt stock 60 includes a front portion with a forward-facing projection 60*a* that includes longitudinally extending vertical flanges 62 on either side. Butt stock adapter 30 includes at its rear end a fork 32 having a pair of parallel, longitudinally extending upper 32*a* and lower 32*b* brackets as shown in the longitudinal cross section of FIG. 5. Brackets 32*a* and 32*b* respectively slide above and below butt stock projection 60*a*, and are received between opposite butt stock flanges 62 extending vertically up and down from the opposite outer sides of projection 60*a*, as shown in the transverse cross section of FIG. 6, normal to longitudinal direction 72. Transverse, vertically oriented removable fasteners 34 pass through corresponding openings in the adapter brackets 32*a*, 32*b* and projection 60*a* to removably secure the butt stock to the rear of adapter 30. The arms of brackets 32*a*, 32*b* are disposed along the upper and lower sides of the butt stock projection 60*a*, and provide a lap joint that is particularly resistant to vertical forces on the butt stock.

The rear portion 22*b* of the central chassis includes a rearward facing projection having an upwardly extending T-shaped flange 23 in the longitudinal direction. On the front of butt stock adapter 30 a forward facing projection 36 has a correspondingly shaped longitudinally oriented slot 37 with an open bottom that slidingly receives T-shaped flange 23 extending upward and longitudinally along the rear 22*b* of the central chassis as shown in the transverse cross section of FIG. 7, normal to longitudinal direction 72. A pair of transverse, vertically oriented removable fasteners 34 pass through corresponding openings in the adapter projection 36 into chassis rear flange 23 to removably secure the central chassis 22 to the front of adapter 30.

The overlapping construction of the fore and aft projections of butt stock adapter 30 with the butt stock and center chassis projections permits a smaller vertical dimension of the connection. This results in a higher elevation of the chassis-to-butt stock joint, thereby creating additional unobstructed palm swell space along the pistol grip 55 upper region 55*a* without affecting the length of trigger pull measurement. The butt stock adapter also maximizes the strength of the joint by using the different strength materials in vertical overlapping thickness, to closely emulate an M16 profile.

The rifle assembly of FIG. 1 includes a monopod leg 76 incorporated into the butt stock 60 that allows the rifle to be leveled to the desired sight range in conjunction with front bipod 80 secured below forestock 68. Monopod leg 76 is secured at the rear end by a pivot 78 at the lower rear portion of butt stock 60 and front end 76*a* extends in a forward direction for movement up and down (toward and away from the butt stock). A ratchet or friction assembly (not shown) within the pivot 68 permits the leg 76 to be securely positioned at the desired height above a surface for supporting the butt stock. The user may easily raise or lower leg 76 with the trigger hand by movement of the trigger hand behind pistol grip 55, so that the rifle 20 is supported on the surface by ends 76*a*, 80*a* and 80*b* of the monopod 76 and bipod 80.

Figure 8:
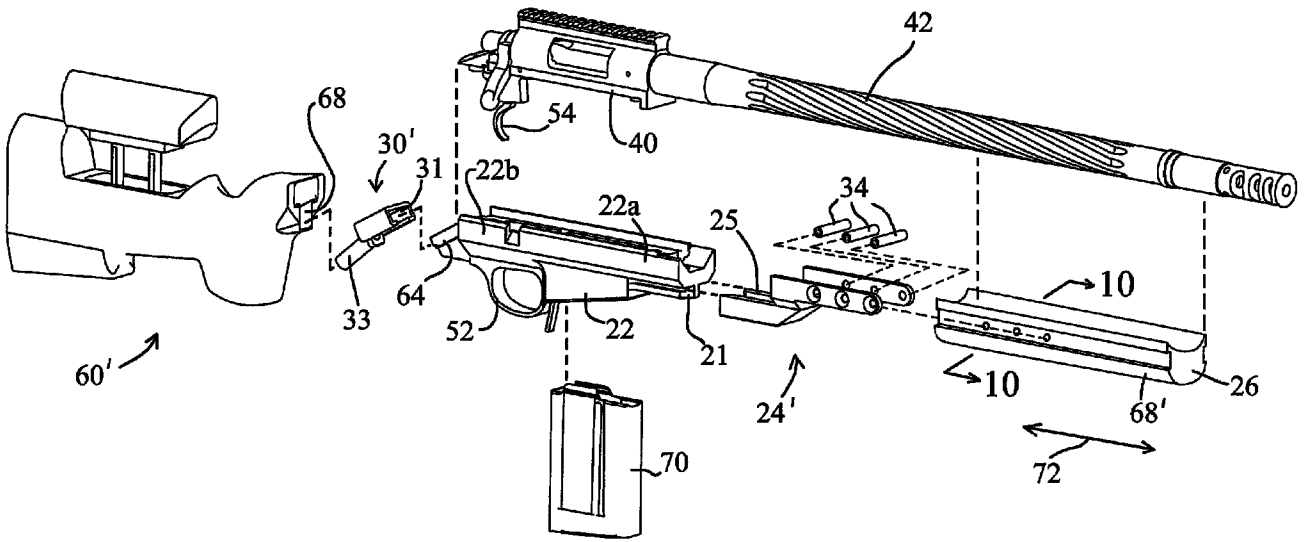
FIG. 8 is an exploded perspective view of another embodiment of the rifle assembly of the present invention.
Figure 9:
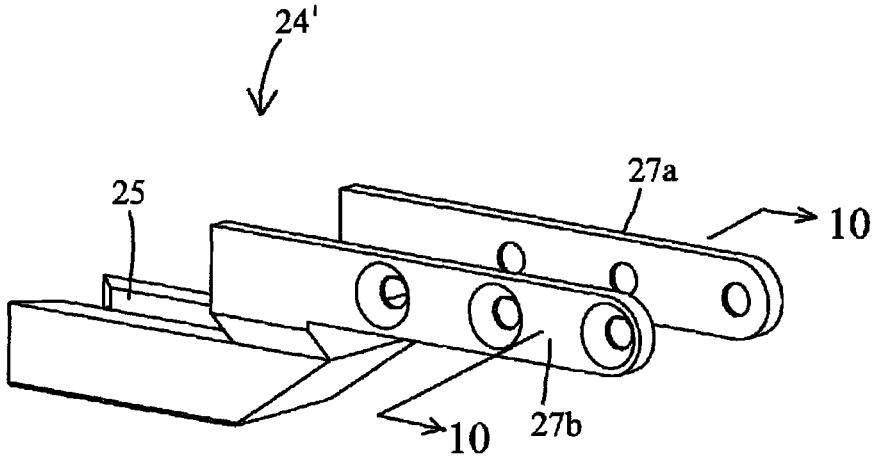
FIG. 9 is a perspective view of the forestock adapter shown in FIG. 8.
Figure 10:
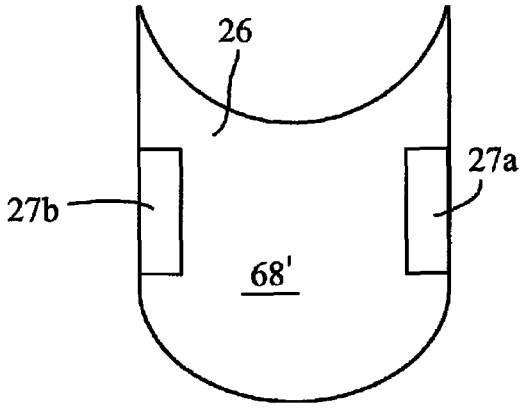
FIG. 10 is a transverse cross-sectional view of the forestock adapter connection to the forestock of the rifle assembly of FIG. 8 along line 10-10 in FIGS. 8 and 9.
Figure 11:
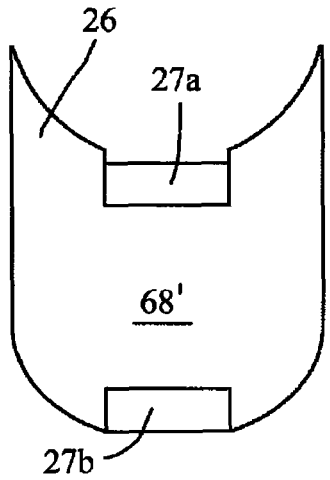
FIG. 11 is a transverse cross-sectional view of an alternate embodiment of the forestock adapter connection to the forestock of the rifle assembly of FIG. 8.

Another embodiment of the rifle assembly and adapters is shown in FIG. 8. As shown in FIG. 8, butt stock 60' is made of wood or polymer construction, but any other material may be used. Forestock adapter embodiment 24' includes rearward facing slot 25 that slides into chassis front portion flange 21, and a forward-facing fork with a pair of parallel, horizontally spaced brackets 27*a*, 27*b* (FIG. 9) that slide onto either side of the rear portion of forestock 68'. Horizontally oriented fasteners 34 fit transversely through corresponding openings in brackets 27*a*, 27*b* and forestock 68' to removably secure the forestock to the forestock adapter (FIG. 10). The arms of brackets 27*a*, 27*b* are disposed along the outside of the forestock, and provides a lap joint that is particularly resistant to horizontal forces on the forestock. Alternatively, brackets 27*a*, 27*b* may be vertically spaced and use transverse, vertically oriented fasteners 34 to secure above and below forestock 68' (FIG. 11) to provide a lap joint with particular resistance to vertical forces on the forestock.

Figure 12:
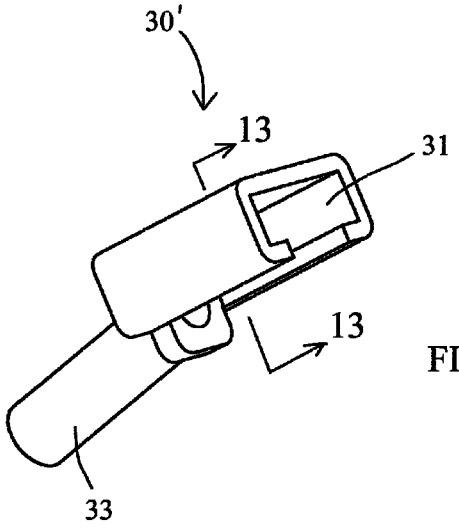
FIG. 12 is a perspective view of the butt stock adapter shown in FIG. 8.
Figure 13:
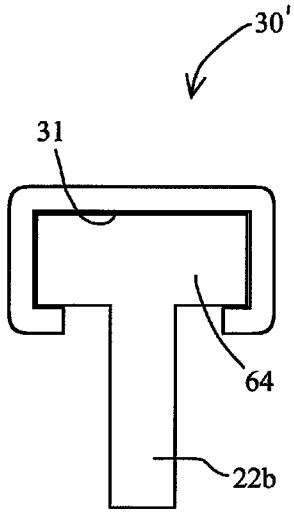
FIG. 13 is a cross sectional view of the butt stock adapter of FIG. 12 when connected to the central chassis along line 13-13.

The alternate embodiment of FIG. 8 further includes butt stock adapter embodiment 30' (FIG. 12). Central chassis 22 has at its rear end 22*b* a rearward-facing projection with flange 64 extending at approximately a 45° angle to the longitudinal direction of the rifle assembly. Except for the angle, the front portion of butt stock adapter 30' is similar to that shown in FIG. 4 and has a forward-facing slot 31 at the same angle as and is correspondingly shaped to chassis rear-facing T-shaped flange 64, so that the central chassis rearward-facing flange at rear end 22*b* may be removably secured in adapter slot 31 (FIG. 13). The rear portion of butt stock adapter 30' includes a projection 33 at an approximately 45° angle to longitudinal which is removably secured in opening 68 at the front portion of butt stock 60'.

The rifle may be assembled by providing the desired central chassis carrying an action including a trigger and a trigger guard, the central chassis having a front portion and a rear portion, the desired fore-end for carrying the barrel, and the desired butt stock. The desired fore-end and butt stock adapter are also provided. The user then removably secures the fore-end adapter rear portion to the central chassis front portion, the fore-end adapter front portion to the fore-end rear portion, the butt stock adapter front portion to the central chassis rear portion, and the butt stock adapter rear portion to the butt stock front portion. The fasteners may also be inserted to the adapters, if provided. The order of the steps of assembly may be varied as desired. Once assembled with the action, trigger, barrel and ammunition, the user may fire the rifle. The rifle may be selectively disassembled and portions of the butt stock and fore-end may be replaced as desired.

Accordingly, the present invention provides easy interchangeability of rifle forestocks and butt stocks with a central chassis, while ensuring high strength connections in the rifle assembly.

While the present invention has been particularly described, in conjunction with a specific preferred embodiment, it is evident that many alternatives, modifications and variations will be apparent to those skilled in the art in light of the foregoing description. It is therefore contemplated that the appended claims will embrace any such alternatives, modifications and variations as falling within the true scope and spirit of the present invention.

Thus, having described the invention, what is claimed is:

1. A rifle assembly comprising:

a central chassis having a longitudinal axis and carrying an action including a trigger, a trigger guard and a pistol grip having an upper portion with an unobstructed palm swell longitudinally rear of the trigger, the central chassis having a rearward-facing projection extending longitudinally therefrom above the unobstructed palm swell of the pistol grip;

a butt stock having a front portion with a forward-facing projection; and an adapter having a forward-facing projection abutting the central chassis rearward-facing projection and removably secured thereto, and a rearward-facing projection extending longitudinally therefrom, one of the adapter rearward-facing projection and the butt stock projection having a fork with vertically spaced brackets above and below the other of the butt stock projection and adapter rearward-facing projection and removably secured thereto, the adapter rearward-facing projection and the butt stock forward-facing projection being disposed entirely longitudinally rearward and above the upper portion of the pistol grip and trigger to create an unobstructed palm swell longitudinally rearward of the upper portion of the pistol grip and trigger.

2. The rifle assembly of claim 1 wherein the adapter has a rearward-facing fork with vertically spaced brackets above and below the butt stock projection.

3. The rifle assembly of claim 2 wherein the forward-facing projection of the butt stock has flanges on at least one side of the brackets of the rearward-facing fork of the adapter.

4. The rifle assembly of claim 2 wherein the forward-facing projection of the butt stock has upwardly- and downwardly-projecting flanges on opposite sides of the brackets of the rearward-facing fork of the adapter.

5. The rifle assembly of claim 4 wherein the butt stock forward-facing projection flanges form slots into which are slideable the brackets of the adapter rearward-facing fork.

6. The rifle assembly of claim 4 further including at least one removable fastener disposed between the butt stock forward-facing projection flanges and the brackets of the adapter rearward-facing fork.

7. The rifle assembly of claim 1 wherein one of the adapter forward-facing projection and the central chassis rearward-facing projection has a slot and the other of the central chassis rearward-facing projection and the adapter forward-facing projection has a flange slideable within the slot.

8. The rifle assembly of claim 1 wherein the adapter forward-facing projection has a slot and the central chassis rearward-facing projection has a flange slideable within the slot.

9. The rifle assembly of claim 8 further including at least one removable fastener disposed between the central chassis rearward-facing projection slot and the adapter forward-facing projection flange.

10. A rifle assembly comprising:

a central chassis having a longitudinal axis and carrying an action including a trigger, a trigger guard and a pistol grip having an upper portion with an unobstructed palm swell longitudinally rear of the trigger, the central chassis having a rearward-facing projection extending longitudinally therefrom above the unobstructed palm swell of the pistol grip;

a butt stock having a front portion with a forward-facing projection; and an adapter having a forward-facing projection abutting the central chassis rearward-facing projection and removably secured thereto, and a rearward-facing projection extending longitudinally therefrom, one of the adapter forward-facing projection and the central chassis rearward-facing projection having a slot extending longitudinally and the other of the central chassis rearward-facing projection and the adapter forward-facing projection having a flange extending longitudinally and slideable within the slot, one of the adapter rearward-facing projection and the butt stock projection having a fork with vertically spaced brackets above and below the other of the butt stock projection and adapter rearward-facing projection and removably secured thereto, the adapter rearward-facing projection and the butt stock forward-facing projection being disposed entirely longitudinally rearward and above the upper portion of the pistol grip and trigger to create an unobstructed palm swell longitudinally rearward of the upper portion of the pistol grip and trigger.

11. The rifle assembly of claim 10 wherein the adapter has a rearward-facing fork with vertically spaced brackets above and below the butt stock projection.

12. The rifle assembly of claim 11 wherein the forward-facing projection of the butt stock has flanges on at least one side of the brackets of the rearward-facing fork of the adapter.

13. The rifle assembly of claim 11 wherein the forward-facing projection of the butt stock has upwardly- and downwardly-projecting flanges on opposite sides of the brackets of the rearward-facing fork of the adapter.

14. The rifle assembly of claim 13 wherein the butt stock forward-facing projection flanges form slots into which are slideable the brackets of the adapter rearward-facing fork.

15. The rifle assembly of claim 13 further including at least one removable fastener disposed between the butt stock forward-facing projection flanges and the brackets of the adapter rearward-facing fork.

16. The rifle assembly of claim 10 wherein the adapter forward-facing projection has a slot and the central chassis rearward-facing projection has a flange slideable within the slot.

17. The rifle assembly of claim 16 further including at least one removable fastener disposed between the central chassis rearward-facing projection slot and the adapter forward-facing projection flange.

18. The rifle assembly of claim 10 wherein the adapter has a forward-facing projection abutting a top portion of the central chassis rearward-facing projection.

* * * * *